United States Patent [19]

Rattner

[11] 4,357,537

[45] Nov. 2, 1982

[54] X-RAY DIAGNOSTIC GENERATOR COMPRISING RADIATION SHIELDING SURROUNDING THE X-RAY TUBE

[75] Inventor: Manfred Rattner, Buckenhof, Fed. Rep. of Germany

[73] Assignee: Siemens Aktiengesellschaft, Berlin & Munich, Fed. Rep. of Germany

[21] Appl. No.: 206,269

[22] Filed: Nov. 12, 1980

[30] Foreign Application Priority Data

Dec. 17, 1979 [DE] Fed. Rep. of Germany ..... 2950818

[51] Int. Cl.[3] ..... H05G 1/12

[52] U.S. Cl. ..... 378/103; 378/91

[58] Field of Search ..... 250/418, 419, 402

[56] References Cited

U.S. PATENT DOCUMENTS 4,053,778 10/1977 Franke ..... 250/402

4,238,683 12/1980 Baumann ..... 250/418

*Primary Examiner*—Alfred E. Smith

*Assistant Examiner*—T. N. Grigsby

*Attorney, Agent, or Firm*—Hill, Van Santen, Steadman, Chiara & Simpson

[57] ABSTRACT

In an exemplary embodiment, with a high voltage rectifier, two individual capacitors connected in series across the rectifier output, and radiation shielding surrounding the x-ray tube, the radiation shielding is connected with the connection line of the two individual capacitors in an electrically ungrounded fashion and the cathode of the x-ray tube is connected to ground.

1 Claim, 1 Drawing Figure

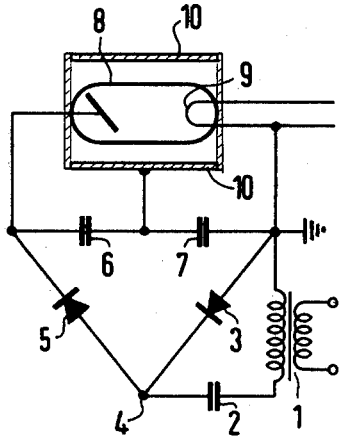
8
10
9
10
6
7
5
3
4
2
1

X-RAY DIAGNOSTIC GENERATOR COMPRISING RADIATION SHIELDING SURROUNDING THE X-RAY TUBE

BACKGROUND OF THE INVENTION

The invention relates to an x-ray diagnostic generator comprising a high voltage rectifier, high voltage capacitor means connected to the rectifier output, and radiation shielding surrounding the x-ray tube, in which the high voltage capacitor means consists of two individual capacitors which are connected in series with one another.

In the German OS No. 24 50 388 (U.S. Pat. No. 4,053,778) an x-ray diagnostic generator is described in which there are provided, at the output of a bridge rectifier in the high voltage circuit, two individual capacitors connected in series with one another whose connection line is connected to ground. Accordingly, the cathode as well as the anode of the x-ray tube conducts half the x-ray tube voltage relative to ground. If there is placed about the x-ray tube a radiation shielding which is connected to ground, then likewise only half the x-ray tube voltage is connected between this radiation shielding and the cathode as well as the anode, which is favorable from an insulation-technical point of view. However, what is disadvantageous in the case of this x-ray diagnostic generator is that the cathode conducts high voltage relative to ground, which signifies that a high voltage-insulated filament (or heating) transformer must be provided for the cathode heating.

SUMMARY OF THE INVENTION

The object underlying the invention resides in designing an x-ray diagnostic generator of the type initially cited such that the radiation shielding conducts only half the high voltage relative to ground while the cathode is connected to ground, so that a high voltage-insulated filament transformer for the x-ray tube can be dispensed with.

In accordance with the invention, this object is achieved in that the radiation shielding is connected with the connection line of the two individual capacitors in an electrically ungrounded fashion and that the cathode of the x-ray tube is connected to ground. In the case of the inventive x-ray diagnostic generator, the insulation problems are simple to master, since the radiation shielding conducts only half the high voltage relative to ground. The cathode of the x-ray tube is then connected to ground, so that a high voltage-insulated filament transformer is not necessary.

The invention shall be explained in greater detail in the following on the basis of an exemplary embodiment illustrated on the accompanying drawing sheet; and other objects, features and advantages will be apparent from this detailed disclosure and from the appended claims.

BRIEF DESCRIPTION OF THE DRAWING

The single FIGURE is an electric circuit diagram illustrating an embodiment in accordance with the present invention.

DETAILED DESCRIPTION

In the drawing a high voltage transformer 1 is illustrated whose secondary winding is connected, at one end to ground potential, and at the other end to a high voltage capacitor 2. Between ground and the capacitor 2 a diode 3 is connected, so that the output voltage of the high voltage transformer 1 is doubled through the series-connection consisting of the secondary winding and the high voltage capacitor 2. Thus, the doubled secondary voltage of the high voltage transformer 1 is connected between ground and the terminal 4 of the high voltage capacitor 2. This voltage is supplied via a high voltage diode 5 to the series-connection of two individual capacitors 6 and 7 for the purpose of smoothing. At this series-connection the high voltage for an x-ray tube 8 is then tapped. The cathode 9 of the x-ray tube 8 is likewise connected to ground potential.

For shielding the x-ray tube radiation issuing from the x-ray tube 8, the x-ray tube 8 is surrounded by radiation shielding 10, for example consisting of lead, which is connected with the connection line extending between the two individual capacitors 6 and 7 in an electrically ungrounded fashion. The radiation shielding 10 possesses a window through which the x-ray radiation can emerge (or exit) for generation of an x-ray image or for x-ray fluoroscopy.

Since the cathode 9 is connected to ground, a high voltage-insulated filament transformer for the cathode heating is not necessary. In relation to the anode as well as in relation to the cathode, the radiation shielding 10 receives only half the high voltage which is applied to the anode of the x-ray tube 8 (relative to cathode potential) because the shielding 10 is held at the potential across capacitor 7 (due to its connection at the connection line between the individual capacitors 6 and 7); thus the insulation of the anode- and cathode-feed line relative to the radiation shielding 10 is simple to master.

Instead of the voltage doubling circuit in the high voltage circuit, also the utilization of another rectifier arrangement; e.g., a bridge rectifier, is possible.

The high voltage capacitors 2, 6, 7 and the insulation for shielding 10, can, for example, be dimensioned for 50 kV, and the capacitors 2, 6 and 7 can have a capacitance of 2 nF; i.e., all three can be designed to be equal if the maximum high voltage at the x-ray tube 8 amounts to 100 kV.

It will be apparent that many modifications and variations may be effected without departing from the scope of the novel concepts and teachings of the present invention.

I claim as my invention:

1. An x-ray diagnostic generator comprising a high voltage rectifier, high voltage capacitor means connected to the rectifier output, and radiation shielding surrounding the x-ray tube, said high voltage capacitor means comprising two individual capacitors (6, 7) having a connection line connecting said capacitors in series relative to one another, the radiation shielding (10) being connected with the connection line connecting the two individual capacitors (6, 7), in an electrically ungrounded fashion, and the cathode (9) of the x-ray tube (8) being connected to ground.

* * * * *